US010115331B2

(12) United States Patent
Lee

(10) Patent No.: US 10,115,331 B2
(45) Date of Patent: Oct. 30, 2018

(54) METHOD AND APPARATUS FOR PROCESSING IMAGE DATA

(71) Applicant: SAMSUNG DISPLAY CO., LTD., Yongin-si, Gyeonggi-do (KR)

(72) Inventor: Myung Woo Lee, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 124 days.

(21) Appl. No.: 15/140,402

(22) Filed: Apr. 27, 2016

(65) Prior Publication Data

US 2017/0116903 A1 Apr. 27, 2017

(30) Foreign Application Priority Data

Oct. 22, 2015 (KR) ..... 10-2015-0147283

(51) Int. Cl.
*G09G 3/20* (2006.01)
*G09G 3/3208* (2016.01)

(52) U.S. Cl.
CPC ..... *G09G 3/2007* (2013.01); *G09G 3/3208* (2013.01); *G09G 2320/029* (2013.01); *G09G 2320/066* (2013.01); *G09G 2330/021* (2013.01)

(58) Field of Classification Search
CPC ..... G09G 3/2007; G09G 3/3208; G09G 2320/029; G09G 2320/066; G09G 2330/021; G06T 5/009; G06T 5/002
See application file for complete search history.

(56) References Cited

U.S. PATENT DOCUMENTS 6,463,173 B1 * 10/2002 Tretter ..... G06T 5/009 382/162
7,003,153 B1 * 2/2006 Kerofsky ..... G06T 5/009 348/E5.119
2004/0184673 A1 * 9/2004 Watanabe ..... G06T 5/009 382/274
2009/0087092 A1 * 4/2009 Min ..... G06T 5/009 382/169
2013/0266219 A1 * 10/2013 Kurita ..... G06T 5/002 382/167
2013/0342585 A1 * 12/2013 Chun ..... G09G 3/3208 345/690
2016/0093031 A1 3/2016 Lee et al.

FOREIGN PATENT DOCUMENTS

KR 10-2016-0039091 A 4/2016

* cited by examiner

*Primary Examiner* — Richard Hong
(74) *Attorney, Agent, or Firm* — Lewis Roca Rothgerber Christie LLP

(57) ABSTRACT

A method for processing image data according to an exemplary embodiment of the present invention includes detecting a gray level distribution of frame image data, calculating a cluster size of each of gray levels based on the gray level distribution, determining a remapping function for increasing contrast of the frame image data based on the gray level distribution and the cluster size, and converting the frame image data based on the remapping function.

18 Claims, 11 Drawing Sheets

FIG. 5B

| GRAY LEVEL → | 0 | 1 | 2 | ... | 72 | 73 | ... | L-1 |
|---|---|---|---|---|---|---|---|---|
| TCS → | - | - | - | ... | 6 | - | ... | - |
| $C_{SIZE}$ → | - | - | - | ... | 3 | - | ... | - |
| LP → | - | - | - | ... | 15 | - | ... | - |

FIG. 5C

| GRAY LEVEL → | 0 | 1 | 2 | ... | 72 | 73 | ... | L-1 |
|---|---|---|---|---|---|---|---|---|
| TCS → | - | - | - | ... | 0 | - | ... | - |
| $C_{SIZE}$ → | - | - | - | ... | 9 | - | ... | - |
| LP → | - | - | - | ... | 18 | - | ... | - |

FIG. 6B

| GRAY LEVEL → | 0 | 1 | 2 | ... | 128 | 129 | ... | L-1 |
|---|---|---|---|---|---|---|---|---|
| TCS → | – | – | – | ... | 12 | – | ... | – |
| $C_{SIZE}$ → | – | – | – | ... | 23 | – | ... | – |
| LP → | – | – | – | ... | 32 | – | ... | – |

METHOD AND APPARATUS FOR PROCESSING IMAGE DATA

CROSS-REFERENCE TO RELATED APPLICATION

This application claims priority to, and the benefit of, Korean Patent Application No. 10-2015-0147283, filed on Oct. 22, 2015, in the Korean Intellectual Property Office, the entire contents of which are incorporated herein by reference in their entirety.

BACKGROUND

1. Field

Embodiments of the present invention relate to a method and an apparatus for processing image data.

2. Description of the Related Art

As lightweight and thin monitors or televisions have been sought after, cathode ray tubes (CRTs) have been replaced by liquid crystal displays (LCDs). However, as a non-emissive element, an LCD not only uses a separate backlight, but also has problems, such as a response speed, a viewing angle, and the like.

Recently, an organic light emitting diode (OLED) display has received attention as a display device for solving problems of LCDs. The OLED display includes two electrodes, and an emission layer positioned therebetween. Electrons injected from one electrode, and holes injected from another electrode, are combined in the emission layer to generate excitons, and the excitons emit light by releasing energy.

The OLED display is superior in terms of response speed, viewing angle, and contrast ratio, as well as power consumption, because the OLED display is a self-emissive type of display, and thus does not require a separate light source. Here, the emission layer is made of an organic material for emitting light exhibiting one of three primary colors, such as red, green, and blue, and light of the primary colors emitted by the emission layer may be spatially summed to display a desired image. On the other hand, a method for processing image data to improve visibility of the displayed image has become a major concern.

The above information disclosed in this Background section is only to enhance understanding, and therefore may contain information that does not form the prior art.

SUMMARY

A method for processing image data according to an exemplary embodiment of the present invention includes detecting a gray level distribution of frame image data, calculating a cluster size of each of gray levels based on the gray level distribution, determining a remapping function for increasing contrast of the frame image data based on the gray level distribution and the cluster size, and converting the frame image data based on the remapping function.

The detecting the gray level distribution of the frame image data may include counting a number of pixel data belonging to each of gray levels among pixel data of the frame image data.

The calculating the cluster size for each of the gray levels may include calculating how closely different pixel data corresponding to a corresponding gray level of the gray levels are positioned to each other in a frame.

The remapping function may be determined by $G(g)=G(g-1)+d(g)$, where g is a corresponding gray level of the gray levels, G(g) is the remapping function for generating a remapped gray level corresponding to the corresponding gray level g, and d(g) is a function that is dependent on the gray level distribution and the cluster size.

d(g) may be determined by $d(g)=1/MAX_{grad}$, when $R(g-1)=1$ and $|G(g)-g|<MAX_{gray_diff}$, where $MAX_{grad}$ represents a maximum rate of change of the remapping function G(g), $MAX_{gray_diff}$ represents a maximum difference value between the remapping function G(g) and an original mapping function, and R(g−1) is a function for representing how low the gray levels are distributed.

The method may further include determining a function R(g) by R(g)=1, when H(g)<RML and Csize(g)=0, and R(g)=0, when H(g)≥RML or Csize(g)≠0, where H(g) is a number of pixel data corresponding to the corresponding gray level g, Csize(g) is the cluster size corresponding to the corresponding gray level g, and RML represents a threshold value of a number of pixel data for determining whether the corresponding gray level g can be merged with another gray level by the remapping function.

The calculating the cluster size of each of the gray levels may include detecting a cluster including two or more pixels corresponding to the corresponding gray level g for each row in the frame, and determining the cluster size Csize(g) based on a number of pixels included in all of the clusters in the frame.

Detecting the cluster including the two or more pixels may include determining whether a distance between the two or more pixels corresponding to the corresponding gray level g is less than a reference adjacent distance value.

The calculating the cluster size of each of the gray levels may include detecting a cluster in which a distance between two or more pixels corresponding to the corresponding gray level g is less than a reference adjacent distance value for each row in the frame, and determining the cluster size Csize(g) based on whether a number of pixels in the cluster is larger than a reference size.

The remapping function may be determined by G(g)=g, when R(g−1) is 0.

d(g) may be determined by d(g)=Grad(g), when $Grad(g)<MAX_{grad}-1$, and $d(g)=MAX_{grad}-1$, when $Grad(g)\geq MAX_{grad}-1$, where Grad(g) is a function that is dependent on how low gray levels that are greater than the corresponding gray level g are distributed, and $MAX_{grad}$ represents a maximum rate of change of the remapping function G(g).

The method may further include determining Grad(g) by $$Grad(g)=\frac{Csize(g)}{TCsize}\times\left\{\left(\sum_{k=g+1}^{L-1}R_g(k)\right)+(G(g-1)-(g-1)+MAX_{gray_diff})\right\},$$

where Csize(g) is the cluster size of the corresponding gray level g, and TCsize is a sum of the cluster sizes of all of the gray levels, and R(g) is a function indicating how low the gray levels are distributed.

The method may further include determining R(g) by R(g)=1, when H(g)<RML and Csize(g)=0, and R(g)=0, when H(g)≥RML or Csize(g)≠0, where H(g) is a number of pixel data having the corresponding gray level g, Csize(g) is a cluster size of the corresponding gray level g, and RML represents a threshold value of a number of pixel data for determining whether the corresponding gray level g can be merged with the other gray level by the remapping function.

The method may further include determining Grad(g) by $$Grad(g) = \frac{Csize(g)}{TCsize} \times \{G(g-1) - (g-1)\},$$

where Csize(g) is the cluster size of the corresponding gray level g, and TCsize is a sum of the cluster sizes of all of the gray levels.

An apparatus for processing image data according to an exemplary embodiment of the present invention includes a cluster calculator configured to detect a distribution of gray levels of frame image data, and configured to calculate a cluster size for each of the gray levels, a gray re-mapper configured to determine a remapping function for increasing contrast of an image corresponding to the frame image data based on the distribution of the gray levels and the cluster size, and a filter configured to convert the frame image data based on the remapping function.

The cluster calculator may be further configured to count a number of pixel data belonging to each of the gray levels among pixel data of the frame image data.

The cluster calculator may be configured to calculate the cluster size by calculating how closely pixel data of a corresponding gray level of the gray levels are positioned to each other in a frame.

The gray re-mapper may be configured to determine the remapping function by $G(g)=G(g-1)+1/MAX_{grad}$, when $R(g-1)=1$ and $|G(g)-g|<MAX_{gray_diff}$ and $G(g)=g$, when $R(g-1)=0$, where $MAX_{grad}$ represents a maximum rate of change of the remapping function, $MAX_{gray_diff}$ represents a maximum difference value between the remapping function and an original mapping function, and R(g) is a function indicating how low the gray levels are distributed.

The gray re-mapper may be configured to determine the R(g) function by $R(g)=1$, when $H(g)<RML$ and $Csize(g)=0$, and $R(g)=0$, when $H(g)\geq RML$ or $Csize(g)\neq 0$, where H(g) is a number of pixel data corresponding to a corresponding gray level g, Csize(g) is a cluster size corresponding to the corresponding gray level g, and RML is a threshold value of a number of pixel data for determining whether the corresponding gray level g can be merged with the other gray level by the remapping function.

The gray re-mapper may be configured to determine the remapping function by $G(g)=G(g-1)+Grad(g)$, when $Grad(g)<MAX_{grad}-1$, and $G(g)=G(g-1)+MAX_{grad}-1$, when $Grad(g)\geq MAX_{grad}-1$, where Grad(g) is a function that is dependent on how low the gray levels that are greater than a corresponding gray level g are distributed, and $MAX_{grad}$ represents a maximum rate of change of the remapping function.

BRIEF DESCRIPTION OF THE DRAWINGS

These and/or other aspects will become apparent and more readily appreciated from the following description of the exemplary embodiments, taken in conjunction with the accompanying drawings in which:

FIGS. 5A, 5B, and 5C illustrate a method of calculating a cluster size for processing image data according to an exemplary embodiment of the present invention;

FIGS. 6A and 6B illustrate another method of calculating the cluster size for processing image data according to an exemplary embodiment of the present invention;

DETAILED DESCRIPTION

Figure 1:
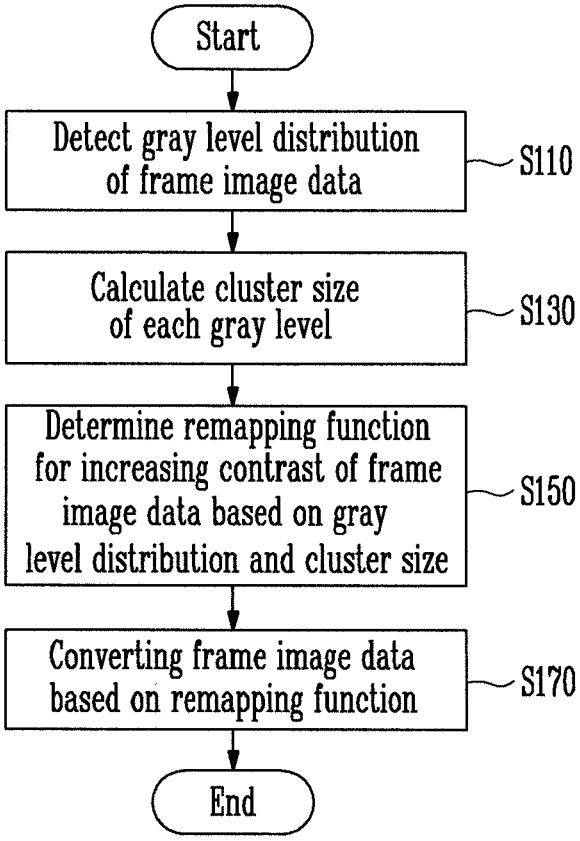
FIG. 1 is a flowchart illustrating a method for processing image data according to an exemplary embodiment of the present invention.

Features of the inventive concept and methods of accomplishing the same may be understood more readily by reference to the following detailed description of embodiments and the accompanying drawings. Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element, layer, region, or component is referred to as being "on," "connected to," or "coupled to" another element, layer, region, or component, it can be directly on, connected to, or coupled to the other element, layer, region, or component, or one or more intervening elements, layers, regions, or components may be present. In addition, it will also be understood that when an element or layer is referred to as being "between" two elements or layers, it can be the only element or layer between the two elements or layers, or one or more intervening elements or layers may also be present.

In the following examples, the x-axis, the y-axis and the z-axis are not limited to three axes of a rectangular coordinate system, and may be interpreted in a broader sense. For example, the x-axis, the y-axis, and the z-axis may be perpendicular to one another, or may represent different directions that are not perpendicular to one another.

The terminology used herein is for the purpose of describing particular embodiments only and is not intended to be limiting of the present invention. As used herein, the singular forms "a," "an," and "the" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

When a certain embodiment may be implemented differently, a specific process order may be performed differently from the described order. For example, two consecutively described processes may be performed substantially at the same time or performed in an order opposite to the described order.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a flowchart illustrating a method for processing image data according to an exemplary embodiment of the present invention.

Referring to FIG. 1, the method for processing image data according to the current exemplary embodiment of the present invention includes: detecting a gray level distribution of frame image data (S110); calculating a cluster size of each gray level based on the detected gray level distribution (S130); determining a remapping function for increasing contrast of the frame image data based on the gray level distribution and the cluster size (S150); and converting the frame image data based on the remapping function (S170).

In the operation S110 of detecting the gray level distribution of frame image data, the number of pixels in corresponding image data that have a gray level (e.g., a gray level value, or a value of a gray level) corresponding to a corresponding gray level (e.g., corresponding ray level g) may be calculated by analyzing the received frame image data. A gray level g has values of 0, 1, 2, . . . , and L−1. For example, when the gray level g of the frame image data is expressed using 8 bits, a total number of gray levels (L) is 256 (i.e., 2^8), and the gray level g has integer values from 0 to 255. In the operation S110 of detecting the gray level distribution of frame image data, the numbers of pixels corresponding to each of the gray levels g may be calculated as a distribution H(g) of the gray levels. The distribution H(g) represents the number of pixels that correspond to each of the gray levels g of 0, 1, 2, . . . , and L−1.

In the operation S130 of calculating the cluster size of each gray level g based on the detected gray level distribution H(g), a cluster size Csize(g) representing locality, which indicates how closely pixels corresponding to each of the gray levels g are positioned within a frame, may be calculated based on the gray level distribution H(g) that is calculated in the operation S110. A method for calculating the cluster size Csize(g) based on the distribution of the gray levels g will be described in detail with reference to FIGS. 5A, 5B, 5C, 6A, and 6B.

In the operation S150 of determining the remapping function for increasing contrast of the frame image data based on the gray level distribution H(g) and the cluster size Csize(g), the remapping function G(g) is determined based on the gray level distribution H(g) calculated in the operation S110, and based on the cluster size Csize(g) calculated in the operation S130. A detailed method of determining the remapping function G(g) based on the gray level distribution H(g) and the cluster size Csize(g) will be described below with reference to FIGS. 7 and 8.

In the operation S170 of converting the frame image data based on the remapping function G(g), the remapping function G(g) determined in the operation 150 may be applied to the received frame image data to convert the image data.

Figure 2:
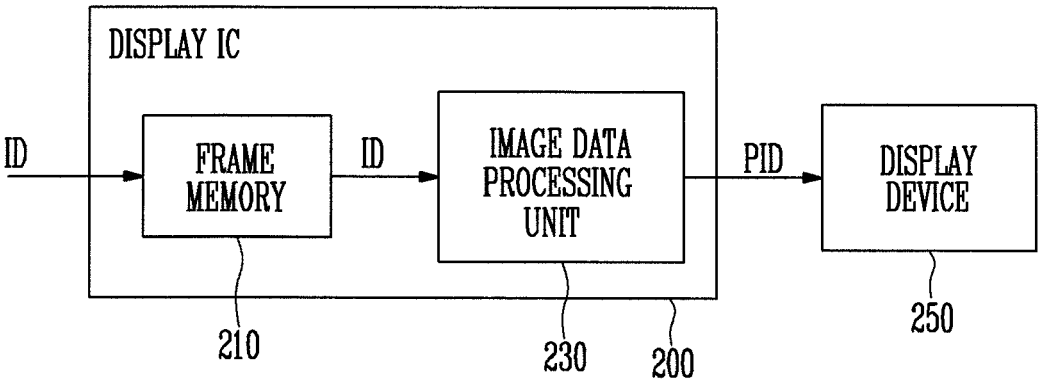
FIG. 2 is a block diagram illustrating an imaging system including an apparatus for processing image data according to an exemplary embodiment of the present invention.

FIG. 2 is a block diagram illustrating an imaging system including an apparatus for processing image data according to an exemplary embodiment of the present invention.

Referring to FIG. 2, the imaging system includes a display IC 200 and a display device 250. In addition, the display IC 200 includes a frame memory 210 and an image data processing unit (e.g., an image data processor) 230.

The frame memory 210 may buffer received frame image data ID, and may provide the frame image data ID to the image data processing unit 230. In the imaging system of the present embodiment, RGB format image data may be converted to YCbCr format data by applying a conversion function. Because the YCbCr format data is expressed by a luminance value Y and by color difference values Cb and Cr, and because the human eye is more sensitive to brightness than colors, the YCbCr format may be effective. For example, the luminance value Y may represent, or may correspond to, the gray level g.

The image data processing unit 230 may analyze the received frame image data ID to detect a gray level distribution H(g), may calculate a cluster size Csize(g) to determine the remapping function G(g), and may convert the received frame image data ID based on the determined remapping function G(g). More specifically, the image data processing unit 230 may determine the remapping function G(g) for increasing contrast of the frame image data ID, based on the distribution H(g) of the gray levels g and the cluster size Csize(g). In addition, the image data processing unit 230 may generate converted frame image data PID by applying the determined remapping function G(g) to the frame image data ID. The converted frame image data PID is image data to which the gray level g is remapped to increase the contrast of the frame image data ID. In this case, the image data processing unit 230 illustrated in FIG. 2 may operate as an apparatus for processing image data according to the current exemplary embodiment of the present invention. A detailed configuration of the image data processing unit 230 will be described below with reference to FIG. 3.

The display device 250 may display the converted frame image data PID that is output from the display IC 200. Because the converted frame image data PID is the image data to which the gray level g is remapped to increase the contrast of the frame image data ID, an image displayed on the display device 250 may have improved contrast. Accordingly, visibility of the displayed image can be improved.

Figure 3:
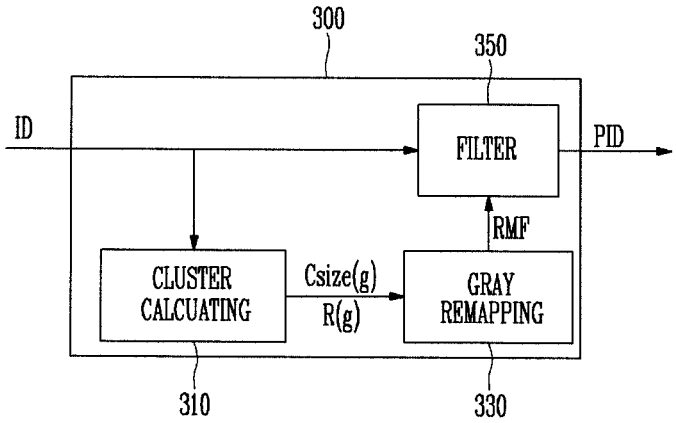
FIG. 3 is a block diagram illustrating an image data processing unit illustrated in FIG. 2.

FIG. 3 is a block diagram illustrating the image data processing unit illustrated in FIG. 2.

Referring to FIG. 3, an image data processing unit (e.g., an image data processor) 300 includes a cluster calculating unit (e.g., a cluster calculator) 310, a gray remapping unit (e.g., a gray re-mapper, or a gray level re-mapper) 330, and a filter unit (e.g., a filter) 350.

The cluster calculating unit 310 detects a distribution H(g) of gray levels g of frame image data ID, and calculates a cluster size Csize(g) for each gray level g. In addition, the cluster calculating unit 310 may calculate a function R(g) indicating how low the gray levels g are distributed, based on the detected distribution H(g) of the gray levels g.

The gray remapping unit 330 may determine the remapping function G(g) for increasing contrast of the frame image data ID, based on the distribution H(g) of the gray levels g and the cluster size Csize(g).

The function R(g) indicating how low the gray levels g are distributed may be, as shown in FIG. 3, calculated from the cluster calculating unit 310, and may then be transmitted to the gray remapping unit 330, or may instead be calculated by the gray remapping unit 330. In this case, the cluster calculating unit 310 may transmit the distribution H(g) of the gray levels g, as well as the cluster size Csize(g), to the gray remapping unit 330. The gray remapping unit 330 may calculate R(g) indicating how low the gray levels g are distributed, based on the cluster size Csize(g) and based on the distribution H(g) of the gray levels g.

The R(g) indicating how low the gray levels g are distributed may be a function having a value of 0 or 1 for each gray level (e.g., each gray level value). When the remapping function G(g) for improving the contrast is calculated, the gray levels g may be remapped to create a remapped gray level. In this case, the function R(g) indicates whether the corresponding gray level g can be merged with the other gray level.

For example, the function R(g) having a value of 0 indicates that the corresponding gray level g cannot be merged with the other gray level, while the function R(g) having a value of 1 indicates that the corresponding gray level g can be merged with the other gray level. For example, when pixel data with a gray level of 85 (e.g., g=85) is to be remapped to a lower gray level, the pixel data having the gray level of 85 may be remapped to a gray level of 84 if the function R(84) is 1. However, if the function R(84) is 0, the pixel data with the gray level of 85 cannot be remapped to a gray level of 84.

When there are many pixel data corresponding to any gray level g (e.g., when H(g) has a large value), overall contrast may be decreased despite the gray level remapping when the corresponding gray level g is merged with the other gray level. Accordingly, only the gray levels g at which H(g) has a low value may be merged with the other gray level by setting the value of the function R(g) to 1, while the gray levels g at which H(g) has a value exceeding a reference value (e.g., a predetermined value) might not be merged with the other gray levels by setting the value of the function R(g) to 0.

Meanwhile, in relation to the cluster size Csize(g) to be described below, when a cluster is present at the corresponding gray level g, and thus Csize(g) is not 0, it is highly likely that pixel data representing a certain shape is included in the corresponding gray level g. In this case, when the corresponding gray level g is merged with the other gray level, because the shape's visibility may be deteriorated, the value of R(g) may be set to 0 even when Csize(g) is not 0.

Setting the value of the function R(g) will be described below with reference to FIGS. 5A, 5B, 5C, 6A, and 6B together with a method of calculating a cluster size Csize(g).

The filter unit 350 may convert the frame image data ID to converted frame image data PID based on the remapping function G(g).

As such, the frame image data ID may be processed based on the distribution H(g) of the gray levels g, the cluster size Csize(g), and the function R(g), such that the contrast of the image displayed on the display device 250 can be improved to improve visibility and/or quality.

Figure 4:
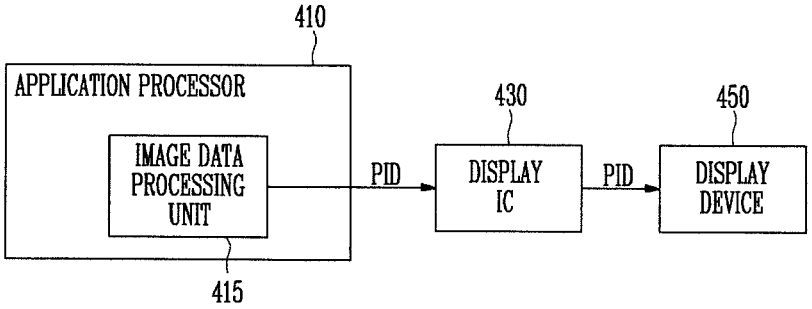
FIG. 4 is a block diagram illustrating an imaging system including an apparatus for processing image data according to another exemplary embodiment of the present invention.

FIG. 4 is a block diagram illustrating an imaging system including an apparatus for processing image data according to another exemplary embodiment of the present invention.

Referring to FIG. 4, the imaging system includes an application processor 410, a display IC 430, and a display device 450. The application processor 410 includes an image data processing unit (e.g., an image data processor) 415. In this case, the image data processing unit 415 illustrated in FIG. 4 may operate as an apparatus for processing image data according to the current exemplary embodiment of the present invention.

Unlike the imaging system of FIG. 2, in the imaging system of FIG. 4, the image data processing unit 415 is included in the application processor 410 instead of being included in the display IC 430. In this case, frame image data generated from the application processor 410 is converted to converted frame image data PID in the image data processing unit 415 inside the application processor 410, and is then transmitted to the display IC 430. The display IC 430 transmits the received converted frame PID to the display device 450. The display device 450 displays the transmitted converted frame image data PID.

As shown in FIGS. 2 and 4, the image data processing units 230 and 415 may be included in the display IC 200 or 430, or may be included in the application processor 410. That is, the method for processing image data according to the current exemplary embodiment of the present invention may be performed by the display IC, or may be performed by the application processor 410. In this case, at least some components of the image data processing unit 230 or 415 can be implemented to include computer readable program code stored in a computer readable storage medium. The computer readable program code that can be read by the computer may be provided to a processor of the application processor 410 or another data processing device.

Figure 5A:
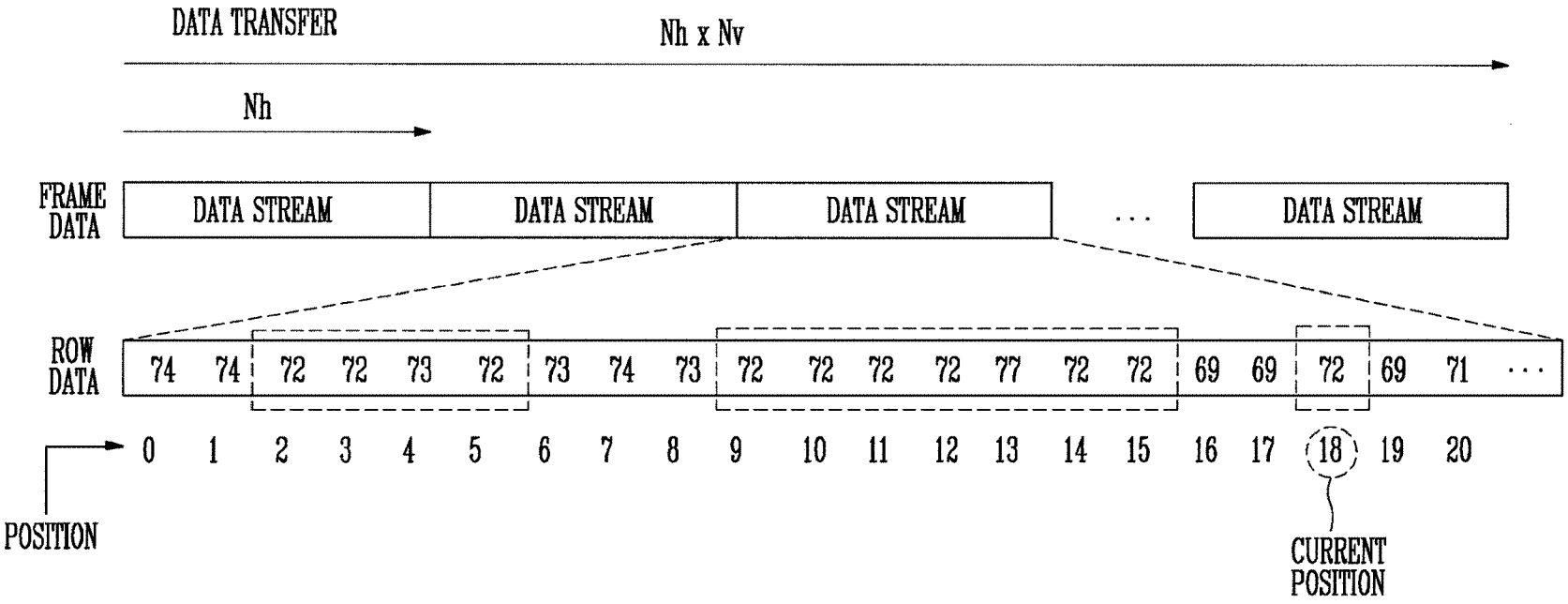

FIGS. 5A, 5B, and 5C illustrate a method of calculating a cluster size for processing image data according to an exemplary embodiment of the present invention.

Referring to FIG. 5A, a stream of frame image data may be provided from an external device, such as an application processor (AP) or an image signal processor (ISP). As shown in FIG. 5A, one frame data may include Nv row data, and one row data may include Nh pixel data. In FIGS. 5B and 5C, for convenience, only gray levels g of pixel data are illustrated.

A distribution H(g) of the gray levels g is obtained as a histogram by counting each of the numbers of the gray levels g of the sequentially received stream of pixel data.

That is, the distribution H(g) of the gray levels g corresponds to the histogram that represents the numbers of pixels corresponding to each of the gray levels g.

A method of calculating a cluster size Csize(g) representing locality for each of the gray levels g will be described with reference to FIGS. 5A, 5B, and 5C.

The locality represents how closely pixels corresponding to each of the gray levels g are positioned to each other within a frame. That is, the locality represents how closely the gray levels g are positioned to each other to thereby form a cluster (e.g., a chunk). Because the image data is received corresponding to each row unit, the locality may be calculated for each row unit. The locality may be calculated using three vectors. The three vectors, such as a temporary cluster size vector TCS storing the number of pixels of each cluster, a cluster size vector Csize representing a total sum of the number of pixels of the cluster in one frame, and a last position vector LP storing a position where each gray level g is last shown in one row, may be used.

After checking the gray level g of the currently received image data, if a value calculated by subtracting the last position vector LP of the corresponding gray level g from the current position is smaller than a reference value (e.g., a predetermined value), a value of the temporary cluster size vector TCS of the gray level g is incremented by 1. On the contrary, if a value calculated by subtracting the last position vector LP of the corresponding gray level g from the current position is greater than the reference value, the value of the temporary cluster size vector TCS is added to the cluster size vector Csize, and the value of the temporary cluster size vector TCS is initialized, or set, to 0. In addition, the value of the last position vector LP is updated to the current position.

In such a way, when the same calculation is performed for all of the rows of one frame image data, the value of the cluster size vector Csize of each gray level g can be calculated, the cluster size vectors Csize may be merged to generate a function for gray levels g, i.e., the cluster size Csize(g). The cluster size Csize(g) represents locality of each gray level g.

As described above, for each of the rows in the frame, the clusters, in which two or more pixels corresponding to a gray level g are formed close to each other, may be detected, and the cluster size Csize(g) may be configured based on the number of pixels included in all of the clusters in the frame. When a distance between the two pixels corresponding to the gray level g is less than a reference adjacent distance value, the two pixels may be determined to be included in the same cluster.

Vector values before reflecting the current gray level g are illustrated in FIG. 5B, while vector values after reflecting the current gray level g are illustrated in FIG. 5C. In examples of FIGS. 5B and 5C, if the current position at which data is read is 18, as shown in FIG. 5A, the current gray level g is 72, and a value of the corresponding last position vector LP is 15, as shown in FIGS. 5A and 5B. If the reference adjacent distance value is 2, because a difference between the current position (e.g., 18) and the last position (e.g., 15) is 3 (and is thus is greater than 2), the value of the temporary cluster size vector TCS, which is 6, is added to the value of the cluster size vector Csize, which is 3, such that the value of the cluster size vector Csize becomes 9 (see FIG. 5C). Meanwhile, as shown in FIG. 5C, the value of the temporary cluster size vector TCS is initialized to 0, and the value of the last position vector LP is updated to the current position of 18.

Figure 6A:
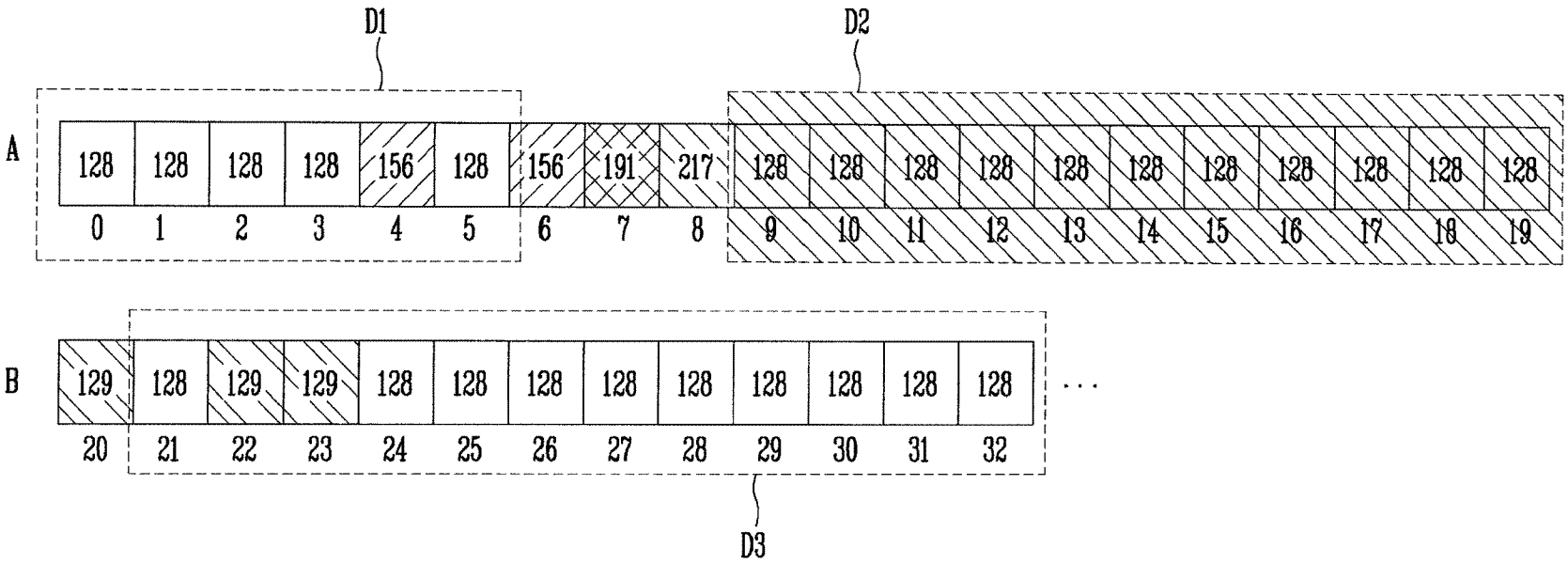

FIGS. 6A and 6B illustrate another method of calculating the cluster size for processing image data according to an exemplary embodiment of the present invention.

Referring to FIG. 6A, gray level values, or the gray levels g, of 20 pixels are illustrated in row A, and gray levels g of up to 13 pixels are illustrated in row B. In another method, where a cluster size is calculated according to the current exemplary embodiment of the present invention, when a difference between the values of the gray levels g adjacently positioned within a reference adjacent distance value (e.g., a predetermined adjacent distance value) in the received data stream and the value of the gray level g of the current position is less than a reference threshold value (e.g., a predetermined threshold value, hereinafter referred to as the threshold value GDth), the value of the temporary cluster size vector TCS of the current gray level g is incremented.

As shown in FIG. 6A, fifth data of row B (e.g., a fifth position of data of row B) has a gray level of 128, and the last position (e.g., closest/most recent position previous to the fifth position) where the gray level of 128 appears is the second position of row B. Because the distance between the current position and the last position where the gray level of 128 appears is 3, and because the reference adjacent distance value is 2, the gray levels of 128 positioned at the second and fifth positions of row B do not form a cluster (when the method of the embodiment described with reference to FIGS. 5A to 5C is performed), so the value of the cluster size vector TCS is not incremented.

However, when the method of the embodiment described with reference to FIGS. 6A and 6B is performed, gray levels of 129 are present between the gray levels of 128 that are positioned at the second and fifth positions of row B. When the threshold value GDth is determined to be 2, because the difference between gray levels 128 and 129 is 1, and is thus is smaller than the threshold value GDth, the temporary cluster size vector TCS of the current gray level g of 128 is incremented by 1 at the position of the fifth pixel data of row B.

That is, according to the method of the embodiment described with reference to FIGS. 5A to 5C, the temporary cluster size vector TCS of the gray level of 128 appearing in row B is incremented by 9. This is because the gray level of 128 of the second position of row B does not form a cluster with the subsequent gray levels of 128. However, according to the method described with reference to FIGS. 6A and 6B, the gray levels of 128 included in pixel data/cluster D3 of the row B form a cluster. Accordingly, the temporary cluster size vector TCS of the gray level of 128 appearing in row B is incremented by 10.

Meanwhile, according to the method of determining the cluster size Csize(g) according to the current exemplary embodiment of the present invention, the value of the temporary cluster size vector TCS having a size that is smaller than a reference size (e.g., a predetermined size, or reference number, hereinafter referred to as reference size OBJsize) is discarded. That is, only the temporary cluster size vector TCS having the size that is greater than the reference size OBJsize is added to the cluster size vector Csize.

Referring to FIG. 6A, the temporary cluster size vector TCS of pixel data/cluster D1 of row A is 6, the temporary cluster size vector TCS of pixel data/cluster D2 of row A is 11, and the temporary cluster size vector TCS of the pixel data/cluster D3 of row B is 12. Accordingly, if the reference size OBJsize is determined to be 8, the temporary cluster size vector TCS of the pixel data/cluster D1 is discarded, and the temporary cluster size vector TCS of the pixel data/cluster D2 and the pixel data/cluster D3 is added to the cluster size vector Csize.

Figure 7:
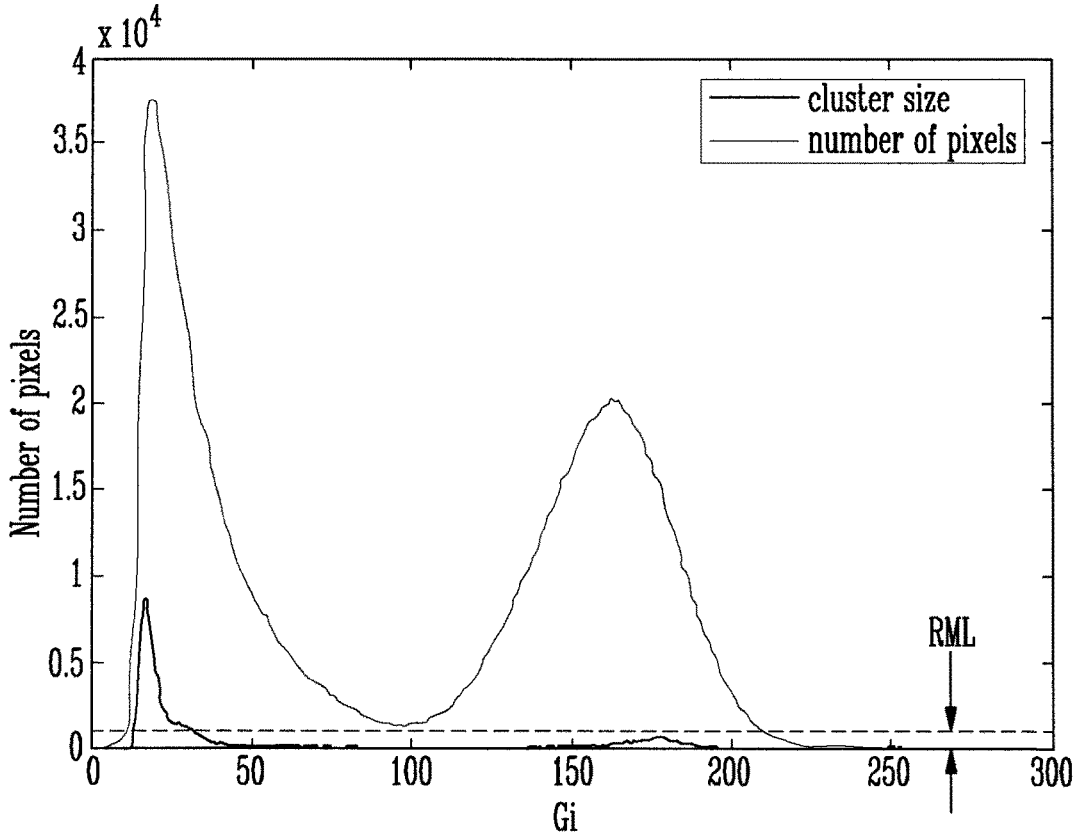
FIG. 7 is a graph illustrating calculation results of the cluster size for processing image data according to an exemplary embodiment of the present invention.

FIG. 7 is a graph illustrating calculation results of the cluster size for processing image data according to an exemplary embodiment of the present invention.

Referring to FIG. 7, the distribution H(g) of the gray levels g included in the frame image data, and the cluster size Csize(g), are illustrated. In addition, a comparison value (e.g., threshold value) RML for determining the function R(g) is illustrated. The distribution H(g) of the gray levels g is illustrated as the number of pixels, and the cluster size Csize(g) is illustrated as the cluster size Csize(g). The comparison value RML for determining the function R(g) is 1500.

In this case, only when the distribution H(g) is smaller than 1500 and the cluster size Csize(g) is equal to 0, then the function R(g) of the corresponding gray level g is determined to be 1. Otherwise, when the distribution H(g) is equal to or greater than the comparison value RML or the cluster size Csize(g) is not equal to 0, then the function R(g) is determined to be 0.

In the method for processing image data according to the current exemplary embodiment of the present invention, the remapping function G(g) may be determined by the following Equation 1.

$$G(g)=G(g-1)+d(g)$$

Here, d(g) is a function that is dependent on the gray level distribution H(g) and the cluster size Csize(g).

First, whether the value of the remapping function G(g) can be remapped to a value that is smaller than the original gray level g is determined. Only when the function R(g−1) is equal to 1 and |G(g)−g| is less than $MAX_{gray_diff}$ the d(g) function may be determined by the following Equation 2.

$$d(g)=1/MAX_{grad}$$

In Equation 2, $MAX_{grad}$ is a reference value (e.g., a predetermined value) representing a maximum rate of change of the remapping function, and $MAX_{gray_diff}$ is a value representing a maximum difference value between the remapping function G(g) and the original mapping function. R(g) is a function for representing how low the gray levels g are distributed, and R(g) illustrates a low level distribution of the gray level g.

In addition, the function R(g) may be determined by the following Equations 3 and 4.

$$R(g)=1,\ \text{if } H(g)<RML \text{ and } \mathrm{Csize}(g)=0$$

$$R(g)=0,\ \text{if } H(g)\geq RML \text{ or } \mathrm{Csize}(g)\neq 0$$

RML is a comparison value (e.g., predetermined value, or a threshold value), and may be a threshold value of the number of pixel data for determining whether the gray level g can be merged with the other gray level in the remapping operation. Referring to FIG. 7, in the example described above, RML may be 1500.

When the value of the remapping function G(g) cannot be remapped to a value that is smaller than the original gray level g (i.e., when R(g−1) is 0), then the value of the remapping function G(g) can be remapped to a value that is greater than the original gray level g.

That is, when R(g−1) is 0, the d(g) function may be determined by the following Equations 5 and 6.

$$d(g)=\mathrm{Grad}(g),\ \text{if } \mathrm{Grad}(g)<MAX_{grad}-1$$

$$d(g)=MAX_{grad}-1,\ \text{if } \mathrm{Grad}(g)\geq MAX_{grad}-1$$

In Equations 5 and 6, Grad(g) is a function that is dependent on how low the gray level of the gray levels g that are greater than the gray level g are distributed, and $MAX_{grad}$ is a reference value (e.g., a predetermined value) representing a maximum rate of change of the remapping function G(g).

In one exemplary embodiment, the Grad(g) function may be determined by the following Equation 7.

$$Grad(g)=\frac{Csize(g)}{TCsize}\times\left\{\left(\sum_{k=g+1}^{L-1}R_g(k)\right)+(G(g-1)-(g-1)+MAX_{gray_diff})\right\}$$

In Equation 7, a TCsize is a sum of the cluster sizes Csize(g) of the entire gray levels.

In another exemplary embodiment, the Grad(g) function may be determined by the following Equation 8.

$$Grad(g) = \frac{Csize(g)}{TCsize} \times \{G(g-1) - (g-1)\}$$

According to Equation 8, power consumption of the organic light emitting diode (OLED) display can be reduced. That is, contrast can be slightly increased while reducing the power consumption.

In yet another exemplary embodiment, when the value of the remapping function G(g) cannot be remapped to a value that is smaller than the original gray level g (i.e., when R(g−1) is 0), the value of the remapping function G(g) can be mapped to the original gray level g. In this case, because the remapping function G(g) can be simply calculated, power consumption can be reduced.

The process may be sequentially performed for the gray level g having the smallest gray level, to the gray level g having the greatest gray level. For example, when the gray level of the gray level g is defined to be a value from 0 to 255, a value of the remapping function G(g) is sequentially calculated for the gray level of the gray level g from 0 to 255. For each gray level of the gray level g, whether the remapping function G(g) can be remapped to a value that is smaller than the current gray level g is determined, and if the remapping is possible, the value of the remapping function G(g) is determined to be smaller than the current gray level g. When G(g) cannot be remapped to a value that is smaller than the current gray level g, whether it can be remapped to a value that is greater than the current gray level g is determined. If the remapping is possible, the value of G(g) is determined to be greater than the current gray level g. Accordingly, contrast of the image data can be improved.

Figure 8:
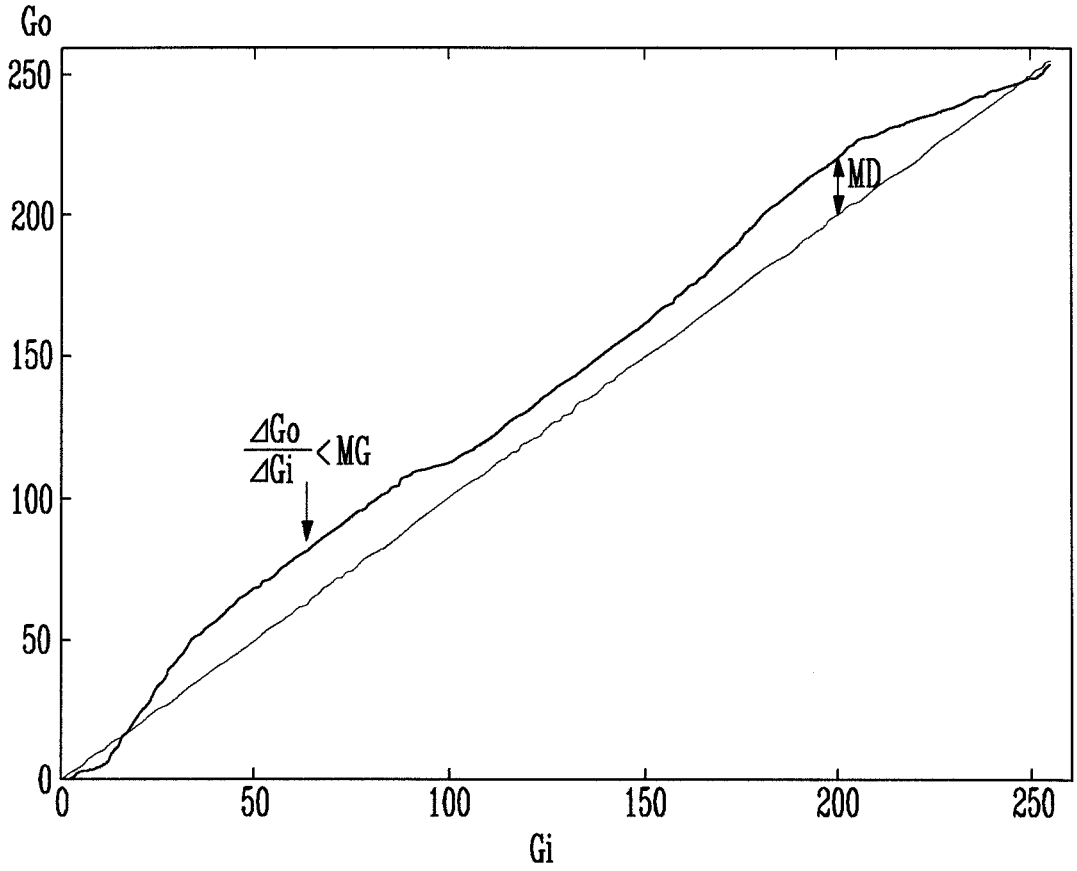
FIG. 8 is a graph illustrating one example of a remapping function that is generated to process image data according to an exemplary embodiment of the present invention.

FIG. 8 is a graph illustrating one example of a remapping function that is generated to process image data according to an exemplary embodiment of the present invention.

The remapping function G(g) calculated according to the method described above is illustrated in FIG. 8. In FIG. 8, MD may be a maximum difference value between the remapping function and the original mapping function. That is, MD may be a value of $MAX_{gray_diff}$. In addition, ΔGo/ΔGi (i.e., a maximum value of a slope of the remapping function G(g)) is smaller than MG. That is, MG, which is a maximum rate of change of the remapping function G(g), may have the same value as the aforementioned $MAX_{grad}$.

That is, the remapping function G(g) may be determined to vary within a rate of change within $MAX_{grad}$, while it differs from the original mapping function by more than $MAX_{gray_diff}$.

Figure 9:
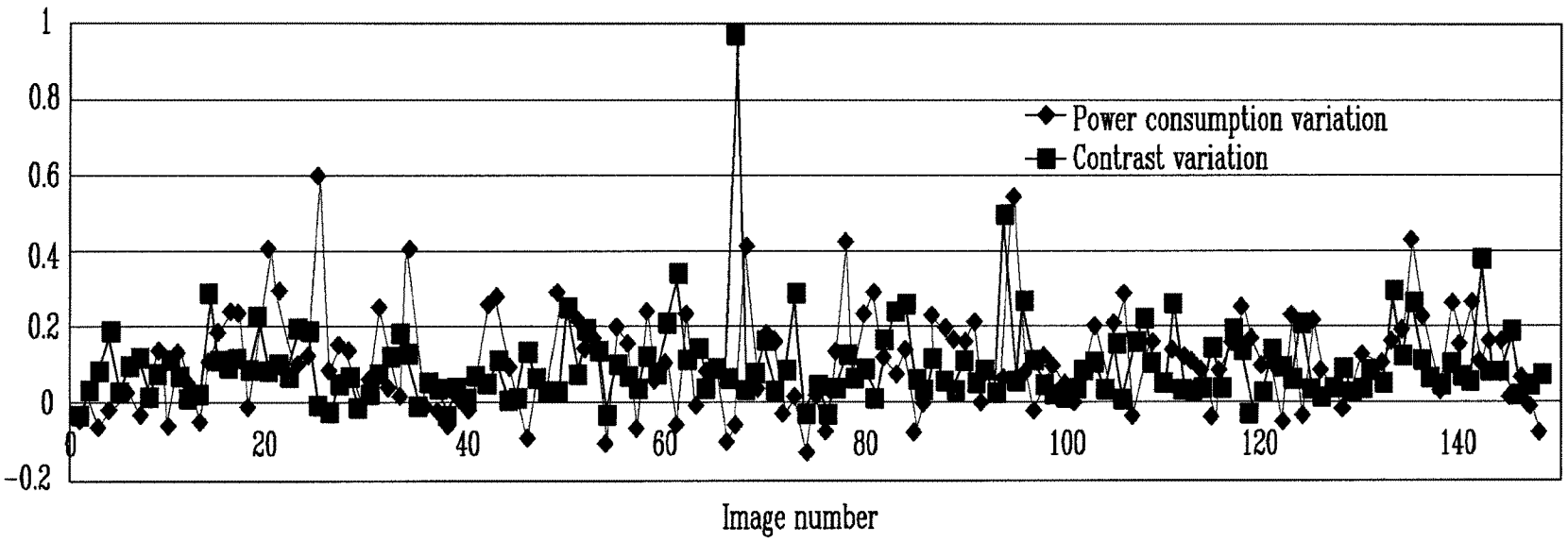
FIG. 9 is a graph illustrating results of performing the method for processing image data according to an exemplary embodiment of the present invention on 148 standard images.

FIG. 9 is a graph illustrating results of performing the method for processing image data according to an exemplary embodiment of the present invention on 148 standard images.

Referring to FIG. 9, when an image is processed using the method for processing image data according to the current exemplary embodiment of the present invention, a contrast per pixel (CPP) value generally increases. In addition, because the gray levels forming a shape are generally varied, visibility of the image can be improved.

In the following Table 1, when the image is processed according to the method for processing image data according to the current exemplary embodiment of the present invention, power and CPP variations are shown. Power before processing (Power_1), power after processing (Power_2), a rate of change of power (ΔPower_r), CPP before processing (CPP_1), CPP after processing (CPP_2), and a rate of change of CPP (ΔCPP_r) are shown.

TABLE 1

| Power_1 | Power_2 | ΔPower_r | CPP_1 | CPP_2 | ΔCPP_r |
|---|---|---|---|---|---|
| 103.60 | 109.60 | 0.11 | 3.55 | 3.84 | 0.10 |

After the processing, it can be seen that power consumption slightly increases but contrast is improved.

FIGS. 10A, 10B, 10C, and 10D are graphs illustrating results of performing the method for processing image data according to an exemplary embodiment of the present invention on an example image.

Figure 10A:
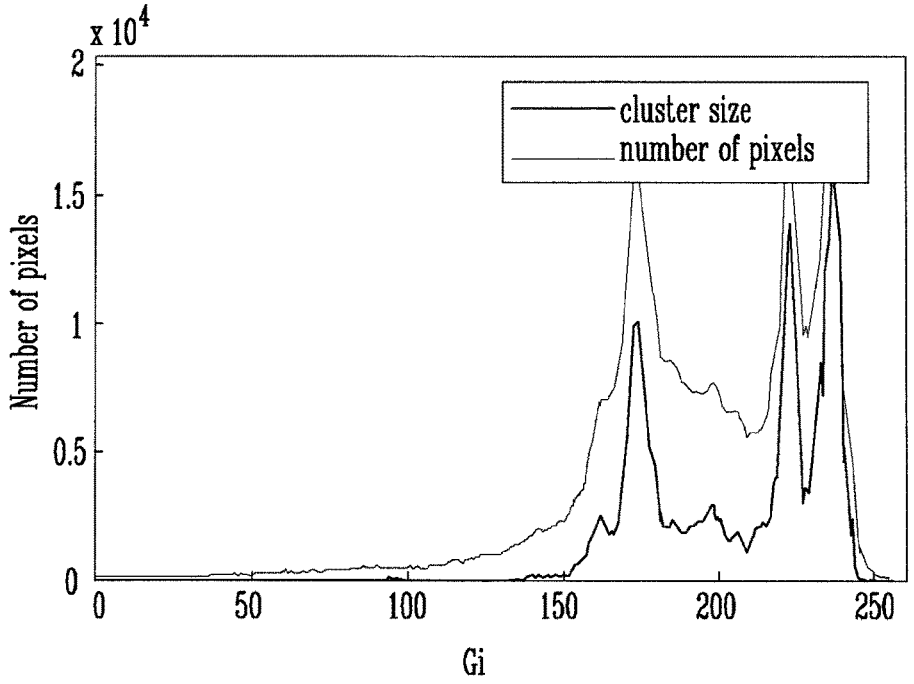
FIGS. 10A, 10B, 10C, and 10D are graphs illustrating results of performing the method for processing image data according to an exemplary embodiment of the present invention on an example image.
Figure 10B:
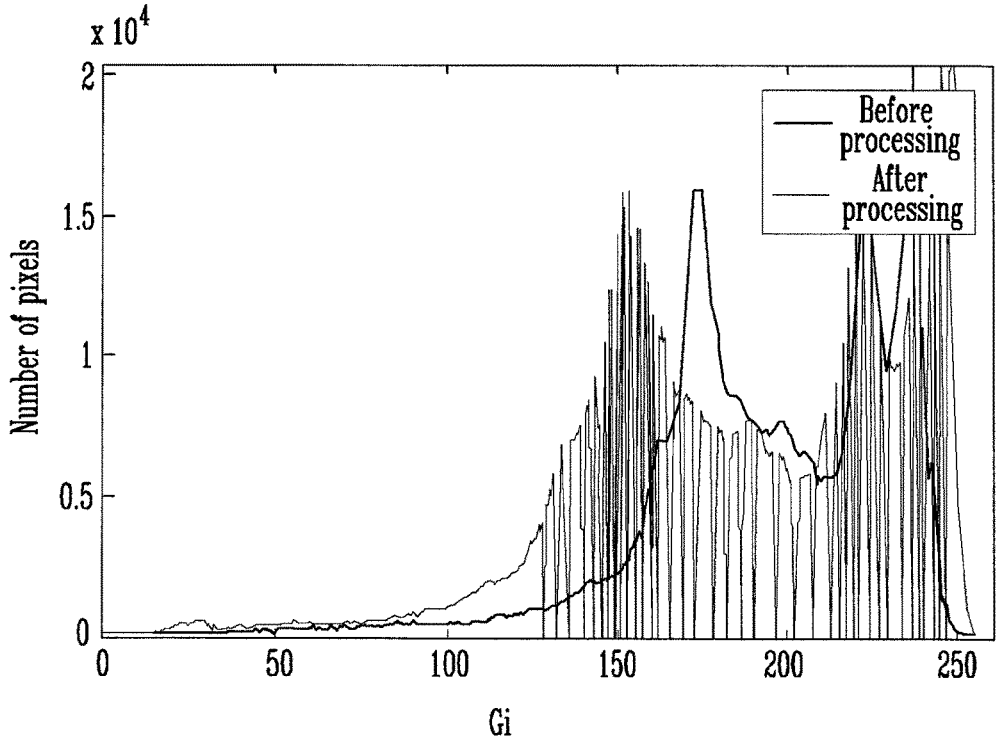
Figure 10C:
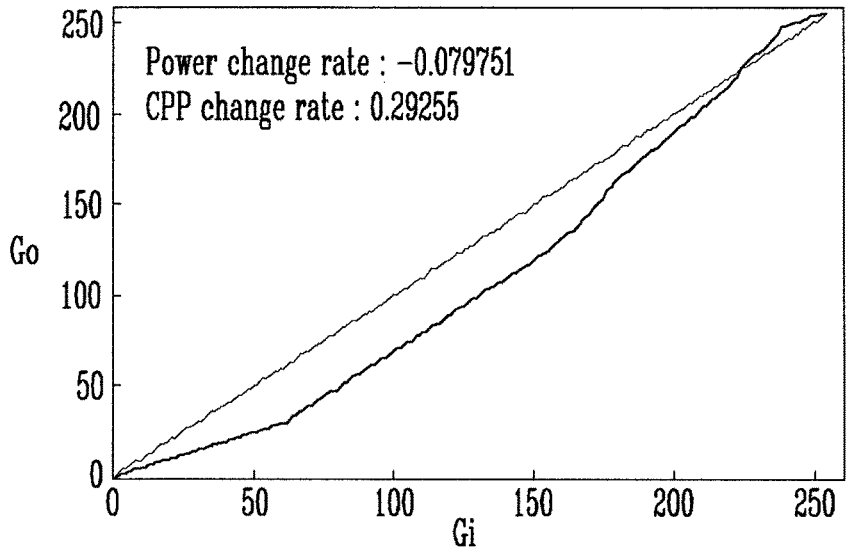
Figure 10D:
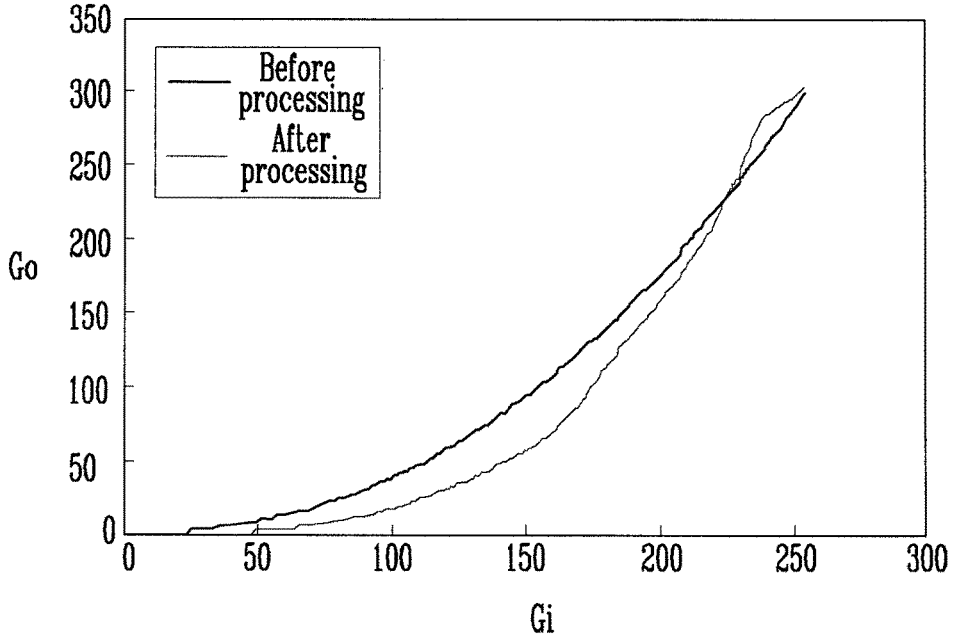

FIG. 10A is a graph illustrating a pixel distribution and a cluster size, FIG. 10B is a graph illustrating the pixel distribution after conversion, FIG. 10C is a graph illustrating a remapping function, and FIG. 10D is a graph illustrating a gamma after conversion. That is, contrast of the image can be improved using the method according to the present invention to improve visibility.

In this case, it is to be understood that a combination of each block of the process flowchart in the drawings and the flowchart in the drawings may be executed by computer program instructions. Because these computer program instructions may be mounted on processors of a general-purpose computer, a special-purpose computer, or other programmable data processing equipment, the instructions executed by the processors of the computer or other programmable data processing equipment generates a means for performing functions described in the flowchart block(s). Because these computer program instructions may use a computer or other programmable data processing equipment-oriented computer or may be stored in a computer readable memory to implement the functions in specific ways, the computer may be used or the instructions stored in the computer readable memory may produce manufactured items including instruction means for executing the functions described in the flowchart block(s). Because the computer program instructions may be installed on a computer or other programmable data processing equipment, a process in which a series of operations is executed on the computer or other programmable data processing equipment by the computer may be generated such that the instructions executed by the computer or other programmable data processing equipment provides the operations for executing functions described in the flowchart block(s).

In addition, each block may represent part of a module, segment, or code of at least one executable instruction for executing the specific logic function(s). In addition, in some alternative example implementations, it should also be noted that the functions described in the blocks can be performed out of sequence. For example, two blocks illustrated in succession may in fact be possible to be carried out substantially concurrently or the blocks may sometimes be executed in the reverse order, depending upon the functionality involved.

In this case, the term "unit" used in the current exemplary embodiment refers to a software or hardware component, such as an FPGA or ASIC, and "unit" performs a certain tasks. However, "unit" is not meant to be limited to the software or hardware. "unit" may be configured to reside on the addressable storage medium or to play one or more processors. Accordingly, as an example, '-unit' includes components such as software components, object-oriented software components, class components, and task components, processes, functions, attributes, procedures, subroutines, program code segments, drivers, firmware, microcode, circuit, data, database, data structures, tables, arrays, and variables. The components and functions provided in the "units" may be combined using a smaller number of components and "units," or may be further separated into additional components and "units." In addition, the components and "unit" may also be implemented so as to play one or more CPUs in a device or a security multimedia card.

According to an exemplary embodiment of the present invention, the method for processing image data capable of improving contrast of a displayed image can be provided.

According to an exemplary embodiment of the present invention, the apparatus for processing image data capable of improving contrast of a displayed image can be provided.

In the exemplary embodiments of the present invention disclosed in the present specification and the drawings, specific examples are presented only to easily describe technical details of the present invention and to help understanding of the present invention, and are not intended to limit the scope of the invention. In addition to the exemplary embodiments disclosed herein, it will be apparent to those of ordinary skill in the art that other exemplary variations based on the scope of the present invention can be practiced.

What is claimed is:

1. A method for processing image data comprising:

detecting a gray level distribution of frame image data;

calculating a cluster size of each of gray levels based on the gray level distribution by determining a locality representing how closely pixels corresponding to each of the gray levels are positioned to each other;

determining a remapping function for increasing contrast of the frame image data based on the gray level distribution and the cluster size; and converting the frame image data based on the remapping function, wherein the remappinq function is determined by:

$$G(g)=G(g-1)+d(g),$$

where g is a corresponding gray level of the gray levels, G(g) is the remappinq function for generating a remapped gray level corresponding to the corresponding gray level g, and d(g) is a function that is dependent on the gray level distribution and the cluster size.

2. The method of claim 1, wherein the detecting the gray level distribution of the frame image data comprises counting a number of pixel data belonging to each of gray levels among pixel data of the frame image data.

3. The method of claim 2, wherein the calculating the cluster size for each of the gray levels comprises calculating how closely different pixel data corresponding to a corresponding gray level of the gray levels are positioned to each other in a frame.

4. The method of claim 1, wherein d(g) is determined by:

$$d(g)=1/\mathrm{MAX}_{grad},\ \text{when } R(g-1)=1 \text{ and } |G(g)-g|<\mathrm{MAX}_{gray_diff},$$

where $\mathrm{MAX}_{grad}$ represents a maximum rate of change of the remapping function G(g), $\mathrm{MAX}_{gray_diff}$ represents a maximum difference value between the remapping function G(g) and an original mapping function, and R(g−1) is a function for representing how low the gray levels are distributed.

5. The method of claim 4, further comprising determining a function R(g) by:

$$R(g)=1,\ \text{when } H(g)<RML \text{ and } \mathrm{Csize}(g)=0;\ \text{and}$$

$$R(g)=0,\ \text{when } H(g)\geq RML \text{ or } \mathrm{Csize}(g)\neq 0,$$

where H(g) is a number of pixel data corresponding to the corresponding gray level g, Csize(g) is the cluster size corresponding to the corresponding gray level g, and RML represents a threshold value of a number of pixel data for determining whether the corresponding gray level g can be merged with another gray level by the remapping function.

6. The method of claim 5, wherein the calculating the cluster size of each of the gray levels comprises:

detecting a cluster comprising two or more pixels corresponding to the corresponding gray level g for each row in a frame; and determining the cluster size Csize(g) based on a number of pixels included in all of the clusters in the frame.

7. The method of claim 6, wherein detecting the cluster comprising the two or more pixels comprises determining whether a distance between the two or more pixels corresponding to the corresponding gray level g is less than a reference adjacent distance value.

8. The method of claim 5, wherein the calculating the cluster size of each of the gray levels comprises:

detecting a cluster in which a distance between two or more pixels corresponding to the corresponding gray level g is less than a reference adjacent distance value for each row in the frame; and determining the cluster size Csize(g) based on whether a number of pixels in the cluster is larger than a reference size.

9. The method of claim 4, wherein the remapping function is determined by:

$$G(g)=g,\ \text{when } R(g-1) \text{ is } 0.$$

10. The method of claim 1, wherein d(g) is determined by:

$$d(g)=\mathrm{Grad}(g),\ \text{when } \mathrm{Grad}(g)<\mathrm{MAX}_{grad}-1;\ \text{and}$$

$$d(g)=\mathrm{MAX}_{grad}-1,\ \text{when } \mathrm{Grad}(g)\geq\mathrm{MAX}_{grad}-1,$$

where Grad(g) is a function that is dependent on how low gray levels that are greater than the corresponding gray level g are distributed, and $\mathrm{MAX}_{grad}$ represents a maximum rate of change of the remapping function G(g).

11. The method of claim 10, further comprising determining Grad(g) by:

$$Grad(g)=\frac{Csize(g)}{TCsize}\times\left\{\left(\sum_{k=g+1}^{L-1}R_g(k)\right)+(G(g-1)-(g-1)+\mathrm{MAX}_{gray_diff})\right\},$$

where Csize(g) is the cluster size of the corresponding gray level g, and TCsize is a sum of the cluster sizes of all of the gray levels, and R(g) is a function indicating how low the gray levels are distributed.

12. The method of claim 11, further comprising determining R(g) by:

$$R(g)=1,\ \text{when } H(g)<RML \text{ and } \mathrm{Csize}(g)=0;\ \text{and}$$

$$R(g)=0,\ \text{when } H(g)\geq RML \text{ or } \mathrm{Csize}(g)\neq 0,$$

where H(g) is a number of pixel data having the corresponding gray level g, Csize(g) is a cluster size of the corresponding gray level g, and RML represents a threshold value of a number of pixel data for determining whether the corresponding gray level g can be merged with the other gray level by the remapping function.

13. The method of claim 10, further comprising determining Grad(g) by:

$$Grad(g) = \frac{Csize(g)}{TCsize} \times \{G(g-1) - (g-1)\},$$

where Csize(g) is the cluster size of the corresponding gray level g, and TCsize is a sum of the cluster sizes of all of the gray levels.

14. An apparatus for processing image data comprising:

a cluster calculator configured to detect a distribution of gray levels of frame image data, and configured to calculate a cluster size for each of the gray levels by determining a locality representing how closely pixels corresponding to each of the gray levels are positioned to each other;

a gray re-mapper configured to determine a remapping function for increasing contrast of an image corresponding to the frame image data based on the distribution of the gray levels and the cluster size; and a filter configured to convert the frame image data based on the remapping function, wherein the gray re-mapper is configured to determine the remapping function by:

$G(g)=G(g-1)+1/\text{MAXgrad}$, when $R(g-1)=1$ and $|G(g)-g|<\text{MAXgray_diff}$; and $G(g)=g$, when $R(g-1)=0$, where MAXgrad represents a maximum rate of change of the remapping function, MAXgray_diff represents a maximum difference value between the remapping function and an original mapping function, and R(g) is a function indicating how low the gray levels are distributed.

15. The apparatus for processing image data of claim 14, wherein the cluster calculator is further configured to count a number of pixel data belonging to each of the gray levels among pixel data of the frame image data.

16. The apparatus for processing image data of claim 15, wherein the cluster calculator is configured to calculate the cluster size by calculating how closely pixel data of a corresponding gray level of the gray levels are positioned to each other in a frame.

17. The apparatus for processing image data of claim 14, wherein the gray re-mapper is configured to determine the R(g) function by:

$R(g)=1$, when $H(g)<RML$ and $\text{Csize}(g)=0$; and $R(g)=0$, when $H(g)\geq RML$ or $\text{Csize}(g)\neq 0$, where H(g) is a number of pixel data corresponding to a corresponding gray level g, Csize(g) is a cluster size corresponding to the corresponding gray level g, and RML is a threshold value of a number of pixel data for determining whether the corresponding gray level g can be merged with the other gray level by the remapping function.

18. An apparatus for processing image data comprising:

a cluster calculator configured to detect a distribution of gray levels of frame image data, and configured to calculate a cluster size for each of the gray levels by determining a locality representing how closely pixels corresponding to each of the gray levels are positioned to each other;

a gray re-mapper configured to determine a remapping function for increasing contrast of an image corresponding to the frame image data based on the distribution of the gray levels and the cluster size; and a filter configured to convert the frame image data based on the remapping function, wherein the gray re-mapper is configured to determine the remapping function by:

$G(g)=G(g-1)+\text{Grad}(g)$, when $\text{Grad}(g)<\text{MAX}_{grad}-1$; and $G(g)=G(g-1)+\text{MAX}_{grad}-1$, when $\text{Grad}(g)\geq \text{MAX}_{grad}-1$, where Grad(g) is a function that is dependent on how low the gray levels that are greater than a corresponding gray level g are distributed, and $\text{MAX}_{grad}$ represents a maximum rate of change of the remapping function.

* * * * *